US007557325B2

(12) United States Patent
Fiechter

(10) Patent No.: US 7,557,325 B2
(45) Date of Patent: Jul. 7, 2009

(54) METHOD FOR MANUFACTURING A MEDICAL NEEDLE

(75) Inventor: Adrian Fiechter, Steffisburg (CH)

(73) Assignee: LASAG AG, Thun (CH)

( * ) Notice: Subject to any disclaimer, the term of this patent is extended or adjusted under 35 U.S.C. 154(b) by 1008 days.

(21) Appl. No.: 10/911,508

(22) Filed: Aug. 5, 2004

(65) Prior Publication Data

US 2005/0049639 A1 Mar. 3, 2005

(30) Foreign Application Priority Data

Aug. 5, 2003 (EP) ..... 03017883

(51) Int. Cl.
*B23K 26/20* (2006.01)
*B23K 26/32* (2006.01)

(52) U.S. Cl. ..... 219/121.61; 219/121.64; 219/121.74; 606/223

(58) Field of Classification Search ..... 219/121.63, 219/121.64, 121.74, 121.78, 121.8, 121.83; 606/222, 223; 112/222
See application file for complete search history.

(56) References Cited

U.S. PATENT DOCUMENTS

| | | | | |
|---|---|---|---|---|
| 1,613,206 | A | 1/1927 | Sessions Souttar | |
| 3,829,791 | A * | 8/1974 | Schwartz | 372/25 |
| 3,835,912 | A | 9/1974 | Kristensen et al. | |
| 4,001,543 | A * | 1/1977 | Bove et al. | 219/121.63 |
| 4,159,686 | A * | 7/1979 | Heim | 112/222 |
| 4,377,165 | A * | 3/1983 | Luther et al. | 604/160 |
| 4,785,868 | A * | 11/1988 | Koenig, Jr. | 165/5 |
| 4,935,029 | A | 6/1990 | Matsutani et al. | |
| 5,001,323 | A * | 3/1991 | Matsutani et al. | 219/121.63 |
| 5,012,066 | A | 4/1991 | Matsutani et al. | |
| 5,064,992 | A * | 11/1991 | Jones et al. | 219/121.63 |
| 5,208,699 | A * | 5/1993 | Rockwell et al. | 359/338 |
| 5,479,980 | A * | 1/1996 | Spingler | 163/5 |
| 5,695,591 | A * | 12/1997 | Hamada et al. | 156/272.8 |
| 5,747,770 | A * | 5/1998 | Bogart | 219/121.72 |
| 5,792,180 | A * | 8/1998 | Munoz | 606/223 |
| 5,986,236 | A * | 11/1999 | Gainand et al. | 219/121.82 |
| 6,364,872 | B1 * | 4/2002 | Hsia et al. | 606/9 |
| 6,926,730 | B1 * | 8/2005 | Nguyen et al. | 606/213 |
| 7,335,513 | B2 * | 2/2008 | Smith et al. | 436/180 |
| 2001/0005708 | A1 * | 6/2001 | Iwai et al. | 492/60 |
| 2002/0110493 | A1 * | 8/2002 | Dales et al. | 422/100 |
| 2003/0187498 | A1 * | 10/2003 | Bishop | 623/1.16 |

FOREIGN PATENT DOCUMENTS

| | | | |
|---|---|---|---|
| EP | 03011210.6 | | 5/2003 |
| FR | 2 520 224 | A1 | 7/1983 |
| JP | 362038787 | A * | 2/1987 |
| JP | 406126477 | A * | 5/1994 |
| JP | 2002045989 | A * | 2/2002 |

* cited by examiner

*Primary Examiner*—Samuel M Heinrich
(74) *Attorney, Agent, or Firm*—Sughrue Mion, PLLC

(57) ABSTRACT

The present invention concerns a method for manufacturing a needle, of the type used in the medical field. This needle is formed by a pulsed laser weld for joining a first portion having a pointed end and a second end having the shape of a tube and for receiving, in a subsequent step, the end of a suture thread. During the welding step, the needle and the incident laser beam are driven in a relative rotational movement whose speed is adjusted such that during the duration of a laser beam pulse, at least one complete revolution is carried out.

14 Claims, 3 Drawing Sheets

METHOD FOR MANUFACTURING A MEDICAL NEEDLE

FIELD OF THE INVENTION

This application claims priority from European Patent Application No. 03017883.4 filed Aug. 5, 2003, the entire disclosure of which is incorporated herein by reference.

The present invention concerns a method for manufacturing a metal medical needle of the type generally used for performing sutures.

More specifically, the present invention concerns a method of this type including the steps of:

a) taking a first main needle portion having a first pointed end and a second end whose periphery is contained within a plane P1, b) taking a second needle portion of tubular shape of axis X2 and of which at least a first end has a periphery contained within a plane P2 substantially perpendicular to axis X2, the dimensions of the second needle portion in plane P2 being less than or equal to the dimensions of the first portion in plane P1, c) arranging the first and second needle portions end to end, such that planes P1 and P2 merge forming an interface between the two needle portions, d) welding the first and second needle portions via the effect of the impact of a pulsed incident laser beam on a weld region located at the interface.

The tubular portion arranged at the non-pointed end of the needle is for assuring the subsequent fixing of the suture thread to the needle.

BACKGROUND OF THE INVENTION

Making such medical needles by welding two portions, a first portion comprising a pointed end and the second portion being of tubular shape has been known for a long time, like for example from U.S. Pat. No. 1,613,206, granted on 4 Jan. 1927.

However, the medical needles that are currently most widely used do not have a structure obtained by joining two initially separate parts. Indeed, current requirements concerning the manufacturing quality of such needles are difficult to attain with conventional welding methods. Methods for spot welding two parts of cylindrical shape are known.

However, such "macroscopic type" methods are difficult to apply to parts as small as portions of medical needles whose diameters are currently of the order of several millimeters, or even less. Indeed, the application of a spot welding method would lead to the formation of small flashes all around the joint between the two portions of needle. The presence of these flashes is of course detrimental for the organic tissue on which the suture is carried out with a needle obtained by such a welding method.

Thus, current medical needles are typically made from a single metal portion one end of which is pointed whereas the second end is substantially planar. A blind hole is thus arranged in the second end for subsequently assuring the fixing of a suture thread. Generally, the blind hole is made by a laser or drill piercing method depending upon the dimensions desired.

This type of manufacturing method has, however, a significant drawback, because the very precise tolerances must be respected as regards the dimensions of the blind hole thereby obtained, in order to guarantee that the suture thread is properly held on the needle.

Another drawback of this type of manufacturing method is linked to the fact that if the blind hole is badly positioned or sized, it can happen that its walls are too thin to withstand the mechanical stresses subsequently experienced when a suture is performed.

SUMMARY OF THE INVENTION

It is an object of the present invention to overcome the aforementioned drawbacks of the prior art by proposing a method for manufacturing medical needles that is quick, inexpensive and efficient, i.e. having a high level of qualitative reproducibility for the needles obtained.

Therefore, the present invention concerns a manufacturing method of the type indicated hereinbefore, characterised in that during step d) a relative rotational movement is induced between the two portions of needle, on the one hand, and the incident laser beam, on the other hand. Further, the method according to the present invention is characterised in that the relative rotational movement speed and the duration of the laser pulses are adjusted in relation to each other such that at least one relative rotational revolution is completed during the duration of one laser beam pulse.

Owing to these advantageous features, the weld obtained is continuous and of homogenous quality over the entire periphery of the needle. Insofar as the tube welded to the main portion of the needle is manufactured by a conventional tried and tested method, its dimensions are guaranteed in a relatively precise manner. Thus, the dimensions of the blind hole of the needle obtained by the method according to the present invention are not subject to fluctuations, from one needle to another, as is the case for the needles of the prior art.

In a preferred embodiment, the first portion of the needle has a substantially cylindrical shape in the region of its second end, preferably of the same dimensions as the second needle portion. Consequently, the passage from one portion to the other has no discontinuity when the needle is assembled.

In a preferred manner, the two needle portions are applied against each other with a certain pressure force prior to the welding operation.

According to a preferred implementation variant of the method according to the invention, a preliminary step is provided before the welding operation during which at least two, preferably three, small welding spots are made between the first and second needle portions in order to hold the latter in a relative position suitable for the welding operation.

According to another advantageous feature of the present invention, one can provide an additional step of making a chamfer at the end of the tube intended to receive the suture thread, this chamfer being oriented towards the inside of the blind hole. Preferably, the chamfer is made by removing matter by laser heating, so as to have a cross-section in the form of an arc of a circle. The presence of such a chamfer facilitates the subsequent introduction of the suture thread inside the blind hole of the needle. Moreover, the chamfer can advantageously be made after the operation for welding the two needle portions, using the same laser machining head and the same relative rotational movement between the needle formed and the incident laser beam. Indeed, currently the chamfer is typically made by using two laser beams with opposite angles of incidence, each of which make half of the chamfer.

As regards implementation of the relative rotational movement between the two needle portions and the incident laser beam, a preferred embodiment of the present invention provides that the two stationary needle portions are arranged on a fixed work-holder whereas the laser beam is driven in rotation about the axis X2 of the tubular portion. A quick movement of the two portions that have to remain stationary in relation to each other is in fact difficult to implement without adversely affecting the welding precision.

BRIEF DESCRIPTION OF THE DRAWINGS

Other features and advantages of the present invention will appear more clearly upon reading the following detailed description, made with reference to the annexed drawings, given by way of non-limiting example and in which.

DETAILED DESCRIPTION

Figure 1:
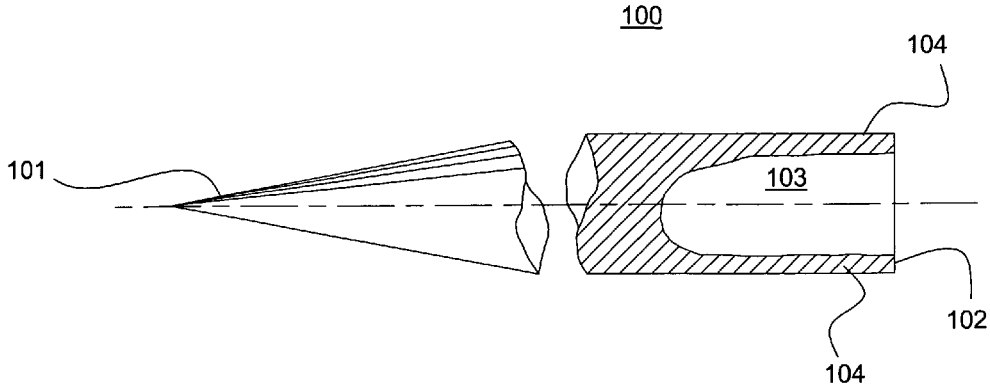
Fig.1 (prior art)
FIG. 1 shows a schematic partial cross-section of a medical needle manufactured in accordance with a method according to the prior art.

FIG. 1 shows a partial cross-section of a medical needle 100 of the type currently used and described hereinbefore. This needle is typically made from a single piece between a first pointed end 101 and a second end 102 whose section is substantially flat. For the sake of clarity, needle 100 is only shown partially, its median part not being visible, the first end 101 being shown in perspective whereas the region of the second end is shown in cross-section. In a conventional manner, the median part can have a rectilinear or curvilinear shape.

Once the "raw" needle has been formed, a blind hole 103 is made in the region of the second end 102 for the purpose of fixing a suture thread (not shown) in a subsequent manufacturing step. In a conventional manner, blind hole 103 is made by a laser drilling method.

However, this laser drilling method has a significant drawback that concerns the precision of the positioning of hole 103 with respect to the needle as well as the precision of the sizing of the hole obtained.

Indeed, very low tolerances have to be respected for positioning the hole, insofar as the walls 104 resulting from forming hole 103 are relatively thin. Thus a bad positioning of hole 103 can lead to walls 104 being formed that are too thin to guarantee good mechanical resistance of needle 100 to deformation, or breakage, when a suture is performed.

Likewise, as was already mentioned hereinbefore, poor sizing of hole 103 can lead to improper holding of the suture thread (not shown) that is intended to be threaded onto it, as well as an irregular shape of hole 103.

The aforementioned problems increase in magnitude when holes with a diameter greater than approximately 0.4 mm are pierced. Consequently, it becomes difficult to respect manufacturing tolerances in such conditions, which means that a high number of needles unsuited for use are obtained.

While seeking to resolve these problems by improving known manufacturing methods, the Applicant developed the method for manufacturing medical needles according to the present invention.

Figure 2:
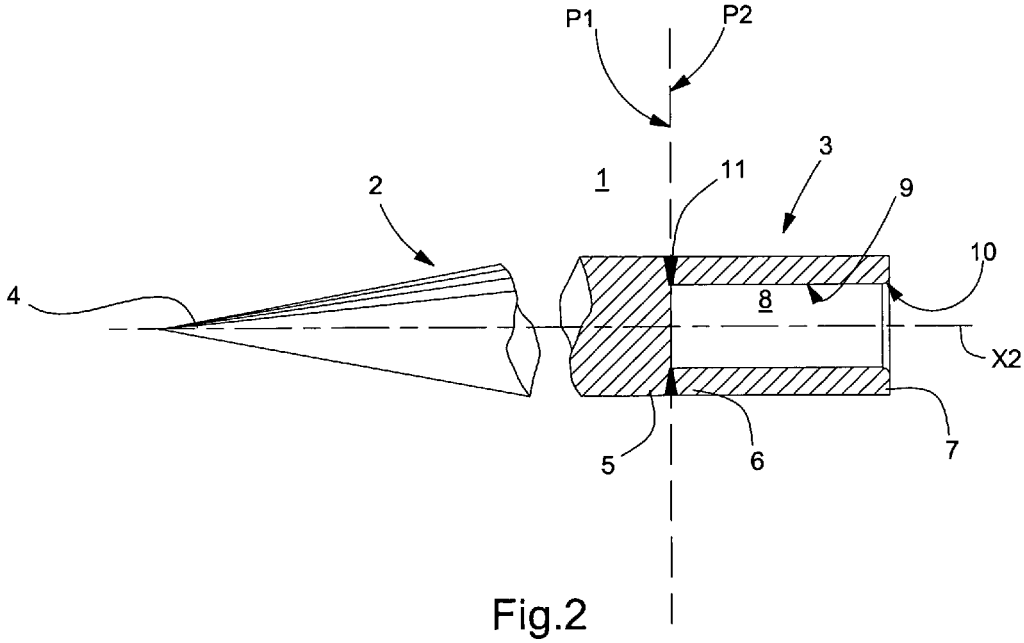
FIG. 2 shows a schematic partial cross-section, similar to the view of FIG. 1, of a medical needle manufactured by a method according to the present invention.

FIG. 2 shows a medical needle 1 obtained by a method according to the present invention, in a similar view to the view of FIG. 1.

Needle 1 comprises two portions, a first main portion 2, partially shown, and a second portion 3 of tubular shape.

The first main portion 2 includes a first pointed end 4 and a second end 5 contained within a plane P1. The median part of the first main portion 2, which is not shown, can have any form, i.e. it can be rectilinear or curvilinear without its form having any effect on the manufacturing method according to the present invention.

The second portion 3 preferably has axial symmetry of axis X2 and includes a first end 6 intended to be welded to first portion 2, contained within a plane P2, substantially perpendicular to axis X2. The second portion 3 further includes a second end 7 through which a suture thread is inserted in a subsequent manufacturing step to connect this to needle 1. Thus, the suture thread must eventually be housed inside blind hole 8 formed by joining first 2 and second 3 portions of needle 1.

In a preferred embodiment of the method according to the present invention, the edge of blind hole 8, i.e. the joint between end 7 of second portion 3 and the peripheral surface 9 of hole 8, is provided with a chamfer 10. Chamfer 10 preferably has a section in substantially the shape of an arc of a circle, with a radius of curvature of the order of several tens or hundreds of micrometers preferably comprised between 10 and 200 micrometers, and ensures a guide function for the suture thread when the latter is threaded in the needle. This measure considerably softens the suture thread insertion conditions and results in a significant time saving as regards the operation for assembling the thread and the needle, which, typically, is automated with a high operating rate of the order of several assemblies per second.

FIG. 2 also shows a structural detail of needle 1, directly connected to its manufacturing method. Indeed, the presence of a weld 11 will be noted at the interface between the first 2 and second 3 portions of the needle. In a preferred manner, the weld extends over the entire thickness of the wall of the second tubular portion, as shown in FIG. 2, so as to guarantee optimum rigidity of the connection between the two portions of the needle. Further, the manufacturing method according to the present invention enables a continuous weld 11 to be formed over the entire periphery of the second portion 3 of excellent quality both mechanically and visually.

The first 2 and second 3 portions of the needle have been shown here with identical dimensions in the regions of their respective ends that are to be welded together. Thus, needle 1 has an external surface without any irregularities from its pointed end 4 to its end 7 used for fixing the suture thread. Of course, this feature, which is a preferred embodiment, is not limiting. Those skilled in the art could adapt the relative dimensions of the first and second needle portions depending upon their own needs without any particular difficulty and without departing from the scope of the present invention.

It should be noted, however, that because of the subsequent use of the needle, in particular because of the direction of its movements in the organic tissue, it is imperative that the transverse dimensions of the second needle portion are less than or equal to those of the first portion.

Figure 3:
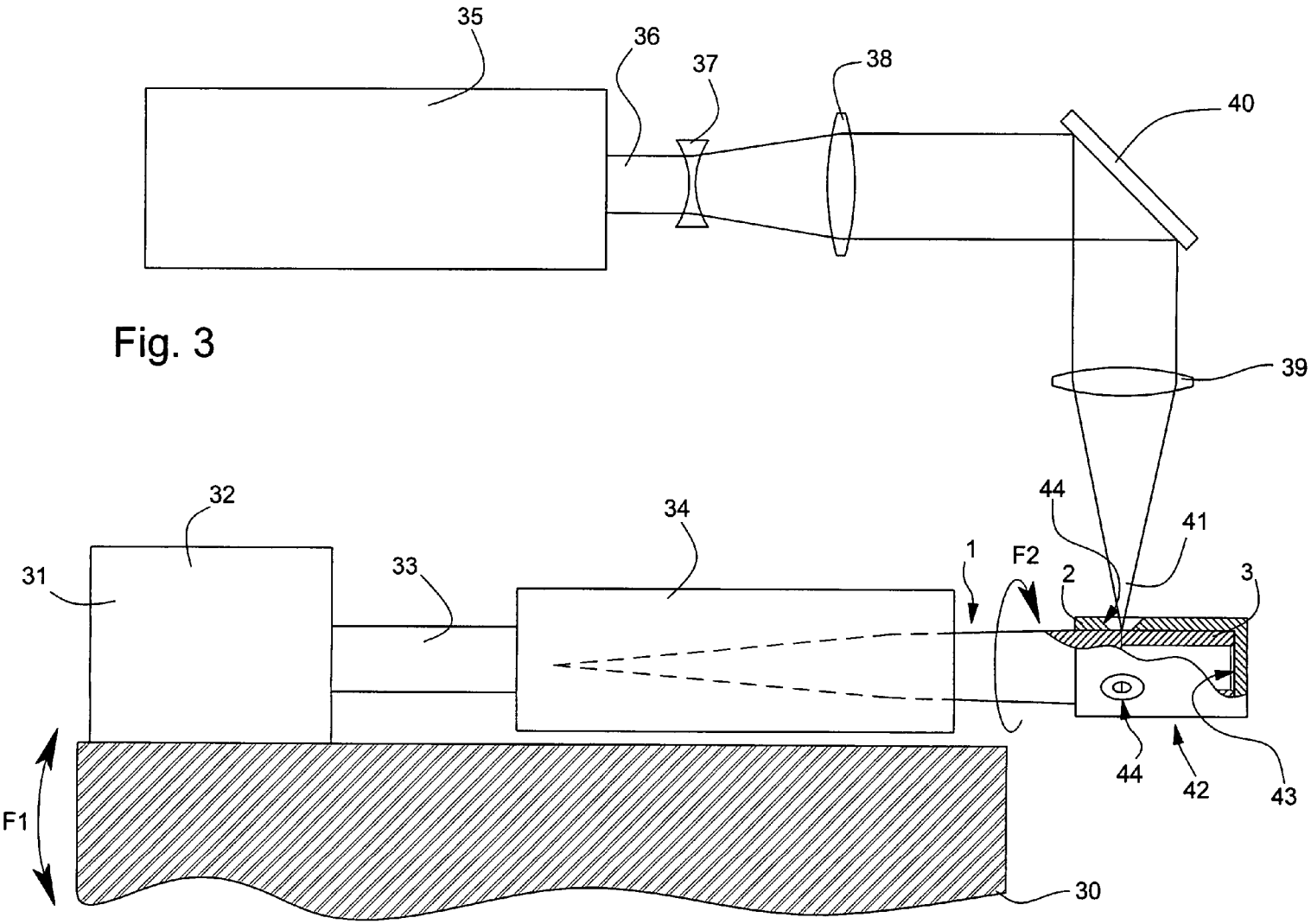
FIG. 3 shows a schematic view of a device used for implementing a first embodiment of the method according to the present invention.
Figure 4:
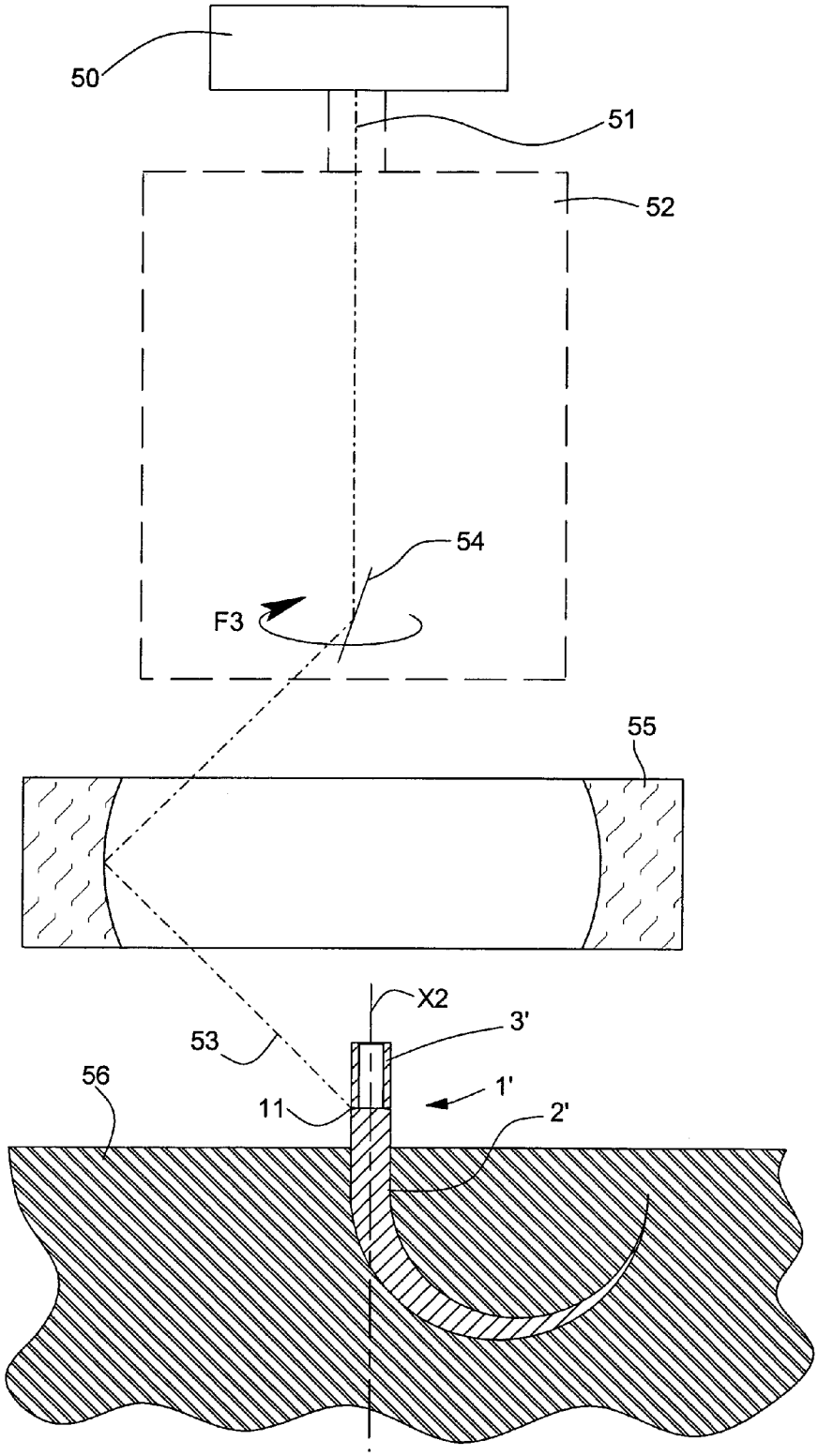
FIG. 4 shows a schematic view of a device used for implementing a second embodiment of the method according to the present invention.

FIGS. 3 and 4 show two implementation examples of method according to the present invention, with different welding devices.

FIG. 3 shows, schematically, a first embodiment of the method according to the invention, according to which the first 2 and second 3 portions of needle 1 are driven in rotation facing a stationary incident laser beam.

For this purpose, a work table 30 can be used, the inclination of whose work surface 31 is preferably able to be adjusted about at least one rotational axis, as indicated by arrow F1, to be able to adjust the angle of incidence of the laser beam on the weld region if necessary.

A motor 32 is secured to work surface 31 and drives a shaft 33 in rotation. Shaft 33 carries a work-holder 34, which is fixed thereto in a rigid manner, for supporting a needle 1 during the welding operation.

The work-holder 34 is provided with conventional means for holding needle 1.

Moreover, the device for implementing the method according to the embodiment of FIG. 3 includes a laser source 35 emitting a laser beam 36 with optical features suited to the envisaged operating conditions, particularly in terms of power and pulse frequency.

Further, the device of FIG. 3 includes conventional optical means for modulating the shape of laser beam 36, such as lenses 37, 38 and 39, and optical means for modifying the direction of laser beam 36, if necessary, such as a mirror 40. Via these optical means, an incident laser beam 41 is obtained whose focal point is located in the region of the interface between the first 2 and second 3 portions of needle 1.

Thus, when the relative positioning between needle 1 and the incident laser beam 41 corresponds to the position necessary for implementing the step of welding the first and second needle portions, work-holder 34 is driven in rotation on itself, in the direction indicated by arrow F2, such that the needle rotates on itself, the interface between its two portions remaining opposite incident laser beam 41.

A significant parameter of the method according to the present invention then consists in adjusting the values of the duration of the pulses of laser beam 36 and the rotational speed of work-holder 34 in relation to each other, such that during the duration of one complete pulse of the laser beam, work-holder 34 effects at least one complete revolution on itself.

Thus, a clean continuous weld is obtained over the entire periphery of needle 1.

According to a preferred variant implementation of the method according to the present invention, the welding of the first and second needle portions is carried out in two steps. A preliminary step can in fact be provided before welding during which the first 2 and second 3 portions of the needle are connected together by at least two welding spots.

For this purpose, a sleeve 42 can be used of the type of that shown in FIG. 3 by way of non-limiting illustration. Sleeve 42 has an overall cylindrical shape and includes a support surface 43 against which the second portion 3 of needle 1 is arranged. Sleeve 42 is then threaded onto end 5 of the first needle portion 2 borne by work-holder 34, such that the first and second needle portions are arranged abutting against each other.

The sleeve also has a plurality of apertures 44 regularly distributed around its periphery and located facing the interface region between the first and second needle portions. The sleeve 42 shown includes 3 apertures 44 arranged at 120° from each other.

Consequently, when work-holder 34 effects at least a first complete revolution on itself, incident beam 41 irradiates the regions of the interface between the first and second needle portions located facing apertures 44 to form small welding spots.

Once the three small welding spots have been formed, in the case of the example shown, sleeve 42 is withdrawn and work-holder 34 is again driven in rotation to carry out the continuous weld, as mentioned hereinbefore.

It should be noted that the method for manufacturing medical needles according to the present embodiment of the invention is applicable to needles whose section is not circular. However, it is clear that the application of this method to making needles of different shapes leads to lesser results in terms of production speed, insofar as the use of support means of the robotic arm type are necessary. Indeed, the movements made by a robotic arm in this case are more complex, thus the weld method is slower overall.

FIG. 4 shows schematically a preferred implementation of the method according to the present invention. A needle of the curvilinear type has deliberately been shown by way of illustration, the shape of the needle not having any effect on the method according to the present invention, as mentioned previously.

In accordance with this preferred implementation of the invention and unlike the preceding implementation, the first 2' and second 3' portions of needle 1' are held in a fixed position during the welding operation, whereas the incident laser beam is driven in a rotational movement.

The present implementation is consequently more favourable from the point of view of the stability of the relative position of the two parts to be welded together, as from the point of view of their positioning facing the incident laser beam.

For this purpose, a particular optical device can preferably be used, for generating a rotating laser beam at a high rotational speed. Such a device is disclosed in EP Patent Application No. 03011210.6 entitled "Apparatus for generating a rotating laser beam", filed 16 May 2003 by the Applicant and the content of which is entirely incorporated by reference in the present Application.

The specific technical means implemented in this optical device will not consequently be described in detail in the present Application.

In order to implement the method, a laser source 50 is used emitting a laser beam 51 through a mechanical system 52 including conventional optical means for adjusting the features of the incident laser beam 53. System 52 further includes a reflective surface 54 and mechanical means (not represented) intended to rotate the reflective surface 54 in the direction indicated by arrow F3 in FIG. 4.

The laser beam is then deviated in the direction of a second reflective surface 55 of overall annular shape and having a concave form in cross section, as is apparent in FIG. 4. Incident laser beam 53 is then emitted from the second reflective surface 55 in the direction of needle 1, with a certain angle of incidence that can be adjusted via the mechanical means of system 52.

Moreover, needle 1 is arranged in a work-holder 56, the relative positioning of system 52 and the needle being adjusted such that the incident laser beam has its focal point substantially in the region of the interface between the first 2 and second 3 portions of needle 1.

Once needle 1 is positioned correctly, the laser beam is emitted and driven in a rotational movement via the rotation of reflective surface 54, such that the incident laser beam travels over the periphery of the needle at the interface between the two portions of the latter.

As in the embodiment previously described, the values of the rotational speed of the reflective surface 54 and the duration of the pulses of laser beam 51 can be adjusted with respect to each other, so that during the duration of one complete pulse of the laser beam, reflective surface 54 completes at least one complete revolution on itself.

Owing to a device of the type described in the cited patent application, it is possible to attain rotational speeds of reflective surface 54 of the order to 20000 revolutions per minute. It is consequently clear that implementation of the present preferred embodiment of the method according to the invention in the production of medical needles procures a significant advantage in terms of production speed. The aforementioned device is particularly advantageous insofar as one need only interrupt the emission of the laser beam between two needles to be manufactured, the mechanical system continuing its rotational movement, which also provides a considerable time saving.

In a similar variant to that described with reference to the preceding implementation, the weld between the first and second needle portions is carried out in two steps, a preliminary step for effecting small welding spots regularly distributed along the periphery of the needle in order to secure them to each other.

For this purpose, a sleeve 42 could be used, as described with reference to the detailed description of FIG. 3.

It should be noted that in each of the embodiments described, it is preferable to make chamfer 10 (FIG. 2) by using the same laser machining head. In each of these cases, in fact, one need only modify the relative position of the needle and the incident laser beam between the welding and chamfer forming operations. Of course, it may be necessary also to modify the power of the laser and/or the duration of its pulses.

Moreover, as mentioned hereinbefore, it is preferable to provide conventional means for applying a relative pressure force between the first and second needle portions prior to the welding step, in order to avoid the formation of air pockets in the weld obtained. Such means have not been described in detail, but the conventional implementation thereof is within the reach of those skilled in the art.

Further, the method according to the present invention could include an additional step of polishing the external surface of needle 1 obtained after making the weld.

The preceding description corresponds to particular embodiments and should in no way be considered limiting, as regards more particularly the shape described and shown for the needle and the sleeve, as well as the structure of the devices used for rotating it or for rotating the incident laser beam.

Furthermore, those skilled in the art will be able to use direct optical coupling between the laser source and the optical laser beam modification devices or a fibre optical coupling depending upon their requirements, without departing from the scope of the present invention.

What is claimed is:

1. A method for manufacturing a metal medical needle including the steps of:

a) providing a first main needle portion having a first pointed end and a second end whose periphery is contained within a plane P1, b) providing a second needle portion of tubular shape of axis X2 and of which at least a first end has a periphery contained within a plane P2 substantially perpendicular to axis X2, the dimensions of said second needle portion in said plane P2 being less than or equal to the dimensions of said first portion in said plane P1, c) arranging said first and second needle portions end to end, such that said planes P1 and P2 merge forming an interface between said two needle portions, d) welding said first and second needle portions via the effect of the impact of an incident pulsed laser beam onto a weld region located at said interface, wherein during step d) a relative rotational movement is induced between said two needle portions and the incident laser beam, the speed of said relative rotational movement and the duration of the laser pulses being adjusted with respect to each other, such that at least one complete relative revolution is completed during the duration of one laser beam pulse, and wherein said rotational movement of said incident laser beam is achieved by implementing an optical device comprising a rotating reflective surface and an annular reflective surface, said laser beam being first incident on said rotating reflective surface which deviates the laser beam in the direction of said annular reflective surface, this annular reflective surface then reflecting said incident laser beam in the direction of said interface between said two needle portions.

2. The method according to claim 1, wherein said first needle portion is substantially cylindrical in the region of its second end.

3. The method according to claim 1, wherein the dimensions of said second needle portion in said plane P2 are substantially equal to the dimensions of said first portion in said plane P1.

4. The method according to claim 1, wherein in step c), a pressure force is also applied to said first and second needle portions to press them against each other.

5. The method according to claim 1, wherein it includes an additional step of making a chamfer between the second end of the second needle portion and its internal surface.

6. The method according to claim 5, wherein said chamfer has a transverse section in the shape of an arc of a circle.

7. The method according to claim 6, wherein said arc of a circle has a radius substantially comprised between 10 and 200 micrometers.

8. The method according to claim 5, wherein the same laser machining head is used during step d) and for making the chamfer.

9. The method according to claim 1, wherein step d) is implemented twice in succession, a sleeve being arranged on said first and second needle portions during the first implementation and then removed before the second implementation, said sleeve having apertures located facing said interface between said first and second needle portions.

10. The method according to claim 9, wherein said sleeve has three apertures spaced at 120° from each other along the periphery of said sleeve.

11. The method according to claim 1, wherein a polishing step is also provided after step d).

12. The method according to claim 3, wherein a polishing step is also provided after step d).

13. The method according to claim 5, wherein a polishing step is also provided after step d).

14. The method according to claim 1, wherein said annular reflective surface has, in cross-section, a concave profile.

* * * * *